US011433527B2

(12) United States Patent
Wegel et al.

(10) Patent No.: US 11,433,527 B2
(45) Date of Patent: Sep. 6, 2022

(54) ADJUSTABLE CABINET ASSEMBLY APPARATUS

(71) Applicant: Kitchen Cabinet Distributors, Raleigh, NC (US)

(72) Inventors: Glen Wegel, Wake Forest, NC (US); Seth Hayes, Cary, NC (US); Timothy Tomchik, Durham, NC (US)

( * ) Notice: Subject to any disclaimer, the term of this patent is extended or adjusted under 35 U.S.C. 154(b) by 104 days.

(21) Appl. No.: 16/699,611

(22) Filed: Nov. 30, 2019

(65) Prior Publication Data

US 2021/0162580 A1 Jun. 3, 2021

(51) Int. Cl.
*B25H 1/04* (2006.01)

(52) U.S. Cl.
CPC ..... *B25H 1/04* (2013.01)

(58) Field of Classification Search
CPC ... B25B 11/00; B25B 11/02; Y10T 29/53961; Y10T 29/53974; Y10T 29/53983; Y10T 29/54; B25H 1/00; B25H 1/02; B25H 1/04; B25H 1/08; B25H 1/10; B25H 1/14; B27M 3/18
USPC ..... 29/281.1, 281.4, 281.5, 281.6; 254/88; 269/43, 55, 71, 73, 289 R, 296, 308, 329, 269/900, 909
See application file for complete search history.

(56) References Cited

U.S. PATENT DOCUMENTS 3,212,770 A * 10/1965 Stephens ..... B25H 1/0007 269/61
4,209,164 A * 6/1980 Brothers ..... B23K 3/08 269/239
4,485,539 A * 12/1984 Blaine ..... B25B 5/142 29/281.1
5,785,305 A * 7/1998 Stalker ..... B25B 5/142 269/228
5,884,904 A * 3/1999 Martini ..... B25B 5/003 269/41
6,391,144 B1 * 5/2002 Gilbert, Jr. ..... B25B 5/142 156/304.1
6,450,491 B1 * 9/2002 McEvoy ..... B25B 5/068 269/109
6,540,472 B2 * 4/2003 Ewaschuk ..... B23Q 7/005 414/759
7,168,693 B1 * 1/2007 Sjuts ..... B25B 1/103 269/37

(Continued)

FOREIGN PATENT DOCUMENTS

CN 104589290 A * 5/2015
DE 2453808 A1 * 7/1975 ..... A47B 47/042
EP 1568541 A2 * 8/2005 ..... B25H 1/04

*Primary Examiner* — Joseph J Hail
*Assistant Examiner* — Jonathan R Zaworski

(57) ABSTRACT

An adjustable cabinet assembly apparatus may include a rotatable base member and a cabinet assembly frame. The cabinet assembly frame may include a first cabinet face support surface, a second cabinet face support surface, a first cabinet side support surface, and a second cabinet side support surface. The cabinet assembly frame may operably engage the rotatable base member. The cabinet assembly apparatus may include a cabinet assembly adjustment device configured to operably engage with the cabinet assembly frame. The cabinet assembly adjustment device may be configured to adjust the cabinet assembly apparatus between a first assembly configuration and a second assembly configuration.

7 Claims, 7 Drawing Sheets

(56) References Cited

U.S. PATENT DOCUMENTS

| | | | | |
|---|---|---|---|---|
| 7,661,181 | B1 * | 2/2010 | Whitfield | B25B 5/142 29/91.1 |
| 8,070,897 | B2 * | 12/2011 | Tonnigs | B29C 65/604 156/73.1 |
| 8,226,074 | B1 * | 7/2012 | Hughey | B25B 5/006 269/155 |
| 8,556,244 | B2 * | 10/2013 | Coffman | B25B 5/142 269/41 |
| 9,346,152 | B2 * | 5/2016 | Green | B25H 1/14 |
| 9,789,601 | B1 * | 10/2017 | Judge | B25H 1/08 |
| 10,646,979 | B1 * | 5/2020 | Schiveley | B25B 11/02 |

* cited by examiner

ADJUSTABLE CABINET ASSEMBLY APPARATUS

FIELD OF THE INVENTION

The present disclosure generally relates to a cabinet assembly apparatus, and more specifically, to an adjustable cabinet assembly apparatus configured to provide for safe handling and assembly of a cabinetry, such as, for example, a corner base cabinet unit. The adjustable cabinet assembly apparatus may further be configured to provide for increased productivity when assembling differently sized corner base cabinet units.

BACKGROUND

Generally, installation of cabinet units requires one to maintain correct positional relationship of the components during the assembly process. This positional relationship of cabinetry pieces is critical to the assembly process. If the positional relationship of the cabinetry pieces is not maintained during assembly, the cabinetry unit may not be properly installed or could fail structurally. Additionally, multiple sized cabinetry increases the difficulty in maintaining the correct positional relationship of the cabinetry pieces during an assembly process. The assembly process for a first sized cabinetry and a second, differing sized cabinetry usually requires using separate tools and/or instruments that are unsuitable for assembling both the first and second differing sized cabinetry.

Therefore, a need exists for a suitable adjustable cabinet assembly apparatus that provides for reliably and continued positioning of the various cabinetry pieces during the assembly process that is adjustable for differently sized cabinetry.

BRIEF SUMMARY

Example implementations of the present disclosure are directed to an adjustable cabinet assembly apparatus. In some aspects, the adjustable cabinet assembly apparatus may include a rotatable base member, a cabinet assembly frame, and a cabinet assembly adjustment device. Additionally, the cabinet assembly frame may include at least a first cabinet face support surface and a second cabinet face support surface, and at least a first cabinet side support surface and a second cabinet side support surface. The cabinet assembly frame may be operably engaged with the rotatable base member. Further, the cabinet assembly adjustment device may be configured to operably engage the cabinet assembly frame so as to adjust and/or transform the cabinet assembly apparatus between a first assembly configuration and a second assembly configuration.

The adjustable cabinet assembly apparatus may include a cabinet assembly adjustment device that includes at least one arm flap disposed proximate the cabinet assembly frame. The cabinet assembly adjustment device may further include at least one arm tip disposed proximate a distal end of the at least one arm flap. The at least one arm tip may be configured to operably engage the distal end of the at least one arm flap. According to one exemplary aspect, the at least one arm flap and the at least one arm tip may be operably engaged with the cabinet assembly frame to adjust the cabinet assembly apparatus between the first assembly configuration and the second assembly configuration.

According to some aspects, the at least one arm flap disposed proximate the cabinet assembly frame may define at least one securing aperture. Additionally or alternatively, the cabinet assembly apparatus may include at least one securing element. According to one aspect, the securing element may be configured to operably engage the at least one securing aperture.

In one aspect, the cabinet assembly adjustment device may include a first arm flap disposed proximate a first end of the cabinet assembly frame. In another aspect, the second arm flap may be disposed proximate a second end of the cabinet assembly frame. The first end may be longitudinally opposed to the second end of the cabinet assembly frame. The cabinet assembly adjustment device may include a first arm tip disposed proximate a first end of the first arm flap. The second arm tip may be disposed a first end of the second arm flap. In one aspect, a second arm tip may be disposed proximate a first end of the second arm flap, wherein the first arm flap, the second arm flap, the first arm tip, and the second arm tip are operably engaged with the cabinet assembly frame to adjust the cabinet assembly apparatus between the first assembly configuration and the second assembly configuration.

According to one example aspect of the present invention, the first arm flap may define a third cabinet side support surface, the second arm flap may define a fourth cabinet side support surface, the first arm tip may define a third cabinet face support surface, and the second arm tip may define a fourth cabinet face support surface. Additionally or alternatively, the first cabinet face support surface and the second cabinet face support surface may define a downward angle therebetween that is at least 90 degrees. Further, the third cabinet face support surface and the fourth cabinet face support surface may define a downward angle therebetween when disposed in the second cabinet assembly configuration that is at least 90 degrees. According to some aspects, a longitudinal length of the first cabinet face support surface and a longitudinal length of the second cabinet face support surface may be greater than a longitudinal length of the third cabinet face support surface and a longitudinal length of the fourth cabinet face support surface. In some aspects, a longitudinal length of the first cabinet side support surface and a longitudinal length of the second cabinet side support surface are greater than a longitudinal length of the third cabinet side support surface and a longitudinal length of the fourth cabinet side support surface. Alternatively, a longitudinal length of a first cabinet side support surface and a longitudinal length of a second cabinet side support surface may be substantially similar to a longitudinal length of the third cabinet side support surface and a longitudinal length of a fourth cabinet side support surface.

The foregoing illustrative summary, as well as other exemplary objectives and/or advantages of the invention, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
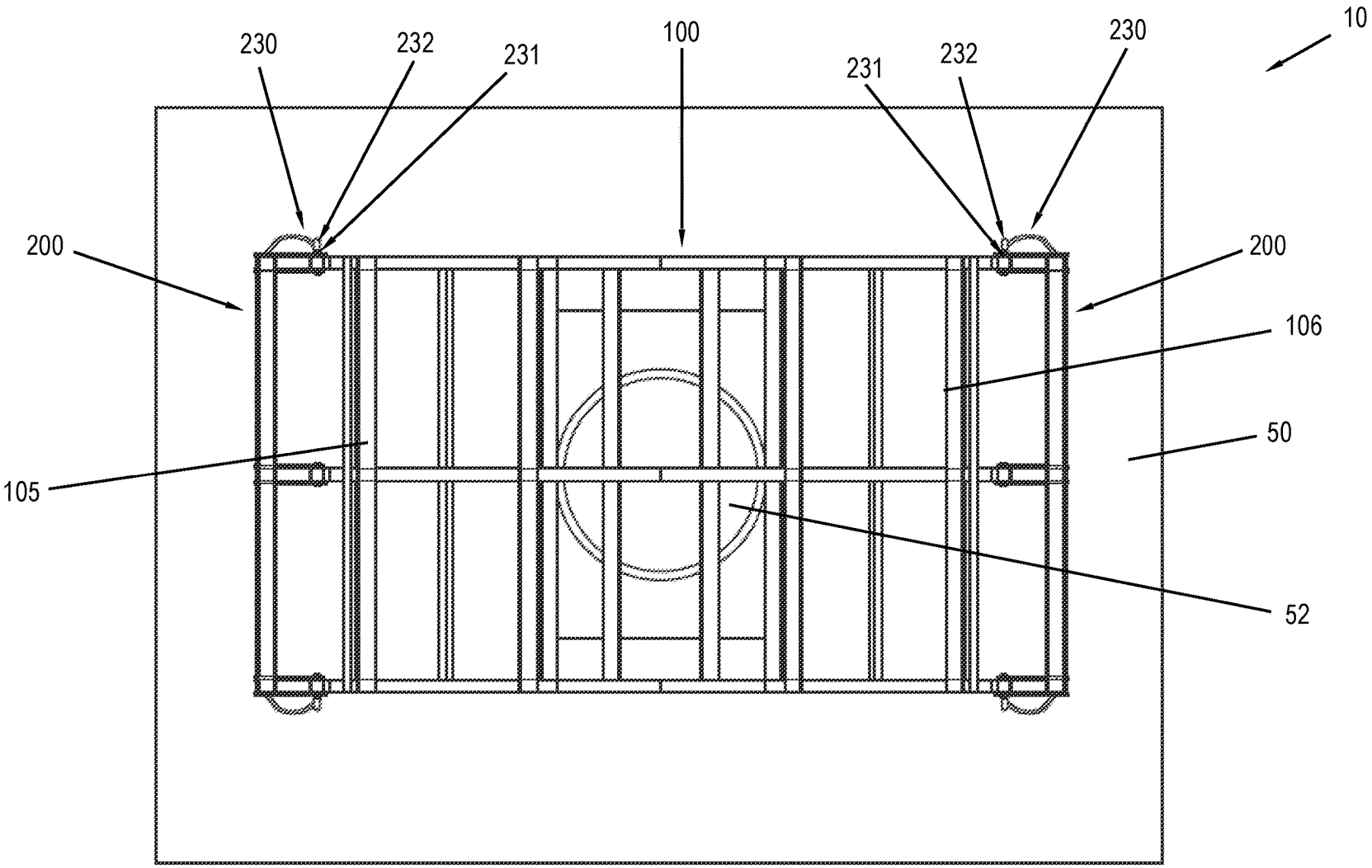
FIG. 1 illustrates a top view of an adjustable cabinet assembly apparatus having a cabinet assembly adjustment device of the adjustable cabinet assembly apparatus disposed in a first assembly configuration according to one example aspect of the present disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Some implementations of the present disclosure will now be described more fully hereinafter with reference to the accompanying drawings, in which some, but not all implementations of the disclosure are shown. Indeed, various implementations of the disclosure may be expressed in many different forms and should not be construed as limited to the implementations set forth herein; rather, these exemplary implementations are provided so that this disclosure will be thorough and complete, and will fully convey the scope of the disclosure to those skilled in the art. As used herein, the term "and/or" and the "/" symbol includes any and all combinations of one or more of the associated listed items. Further, unless otherwise indicated, something being described as being a first, second or the like should not be construed to imply a particular order. It should be understood that the terms first, second, etc. may be used herein to describe various steps, calculations, positions and/or the like, these steps, calculations or positions should not be limited to these terms. These terms are only used to distinguish one operation, calculation, or position from another. For example, a first position may be termed a second position, and, similarly, a second step may be termed a first step, without departing from the scope of this disclosure. Additionally, something may be described as being above something else (unless otherwise indicated) may instead be below, and vice versa; and similarly, something described as being to the left of something else may instead be to the right, and vice versa. As used in the specification, and in the appended claims, the singular forms "a", "an", "the", include plural referents unless the context clearly dictates otherwise. Like reference numerals refer to like elements throughout.

Figure 2:
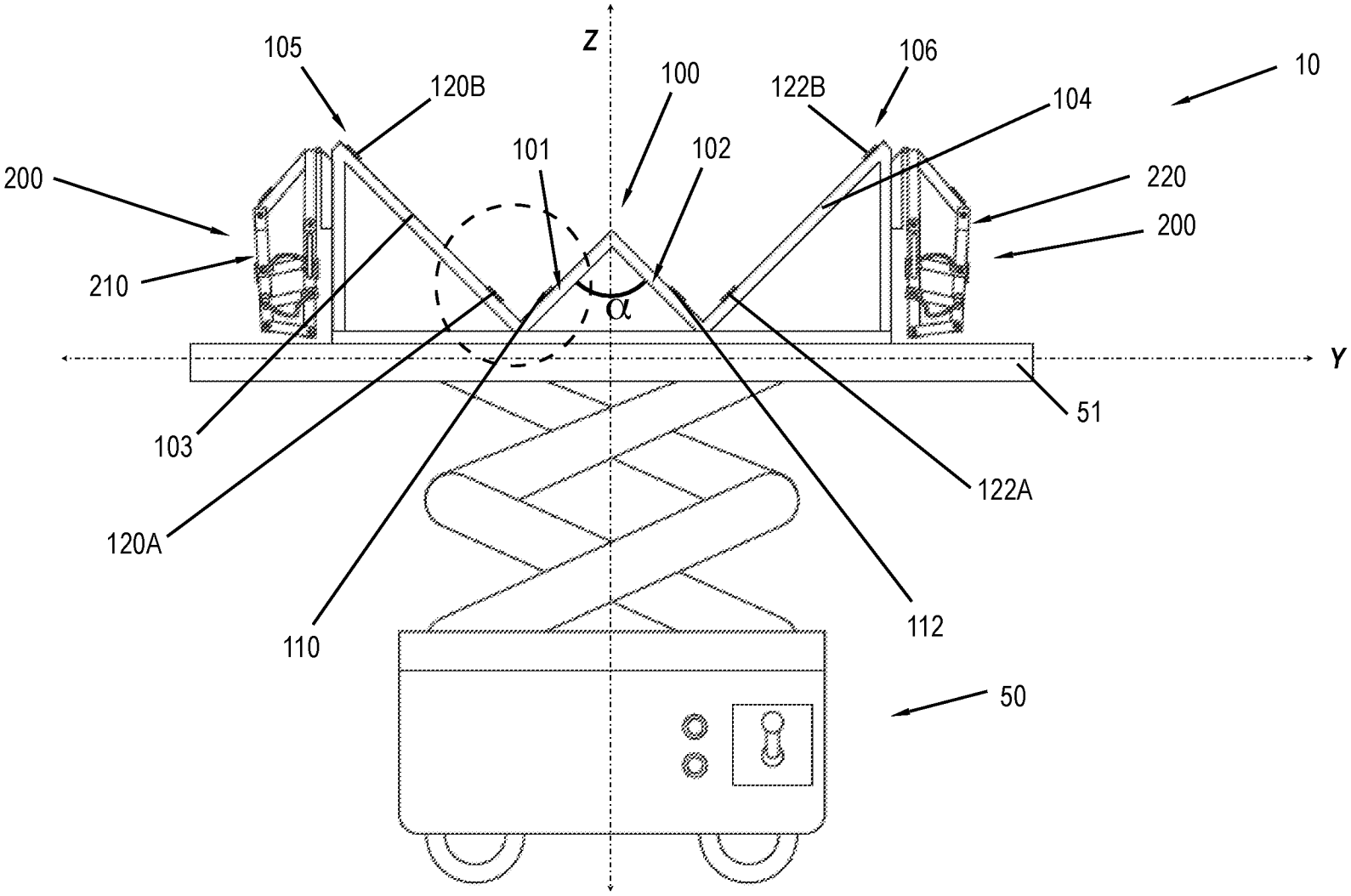
FIG. 2 illustrates a front view of an adjustable cabinet assembly apparatus having a cabinet assembly adjustment device of the adjustable cabinet assembly apparatus disposed in a first assembly configuration according to one example aspect of the present disclosure.
Figure 2A:
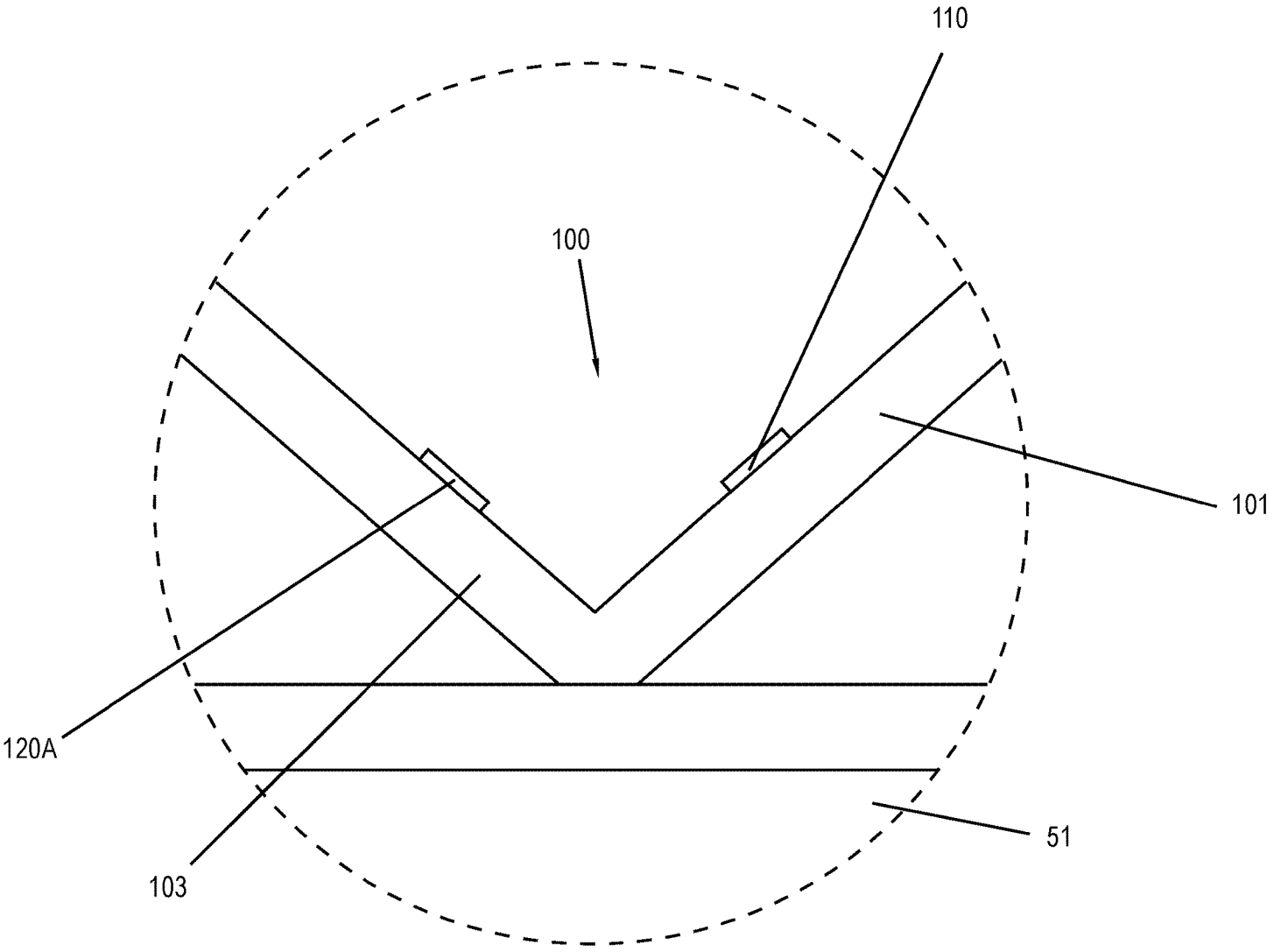
FIG. 2A illustrates a zoomed view of the circle A shown in FIG. 2 according to one example aspect of the present disclosure.
Figure 3:
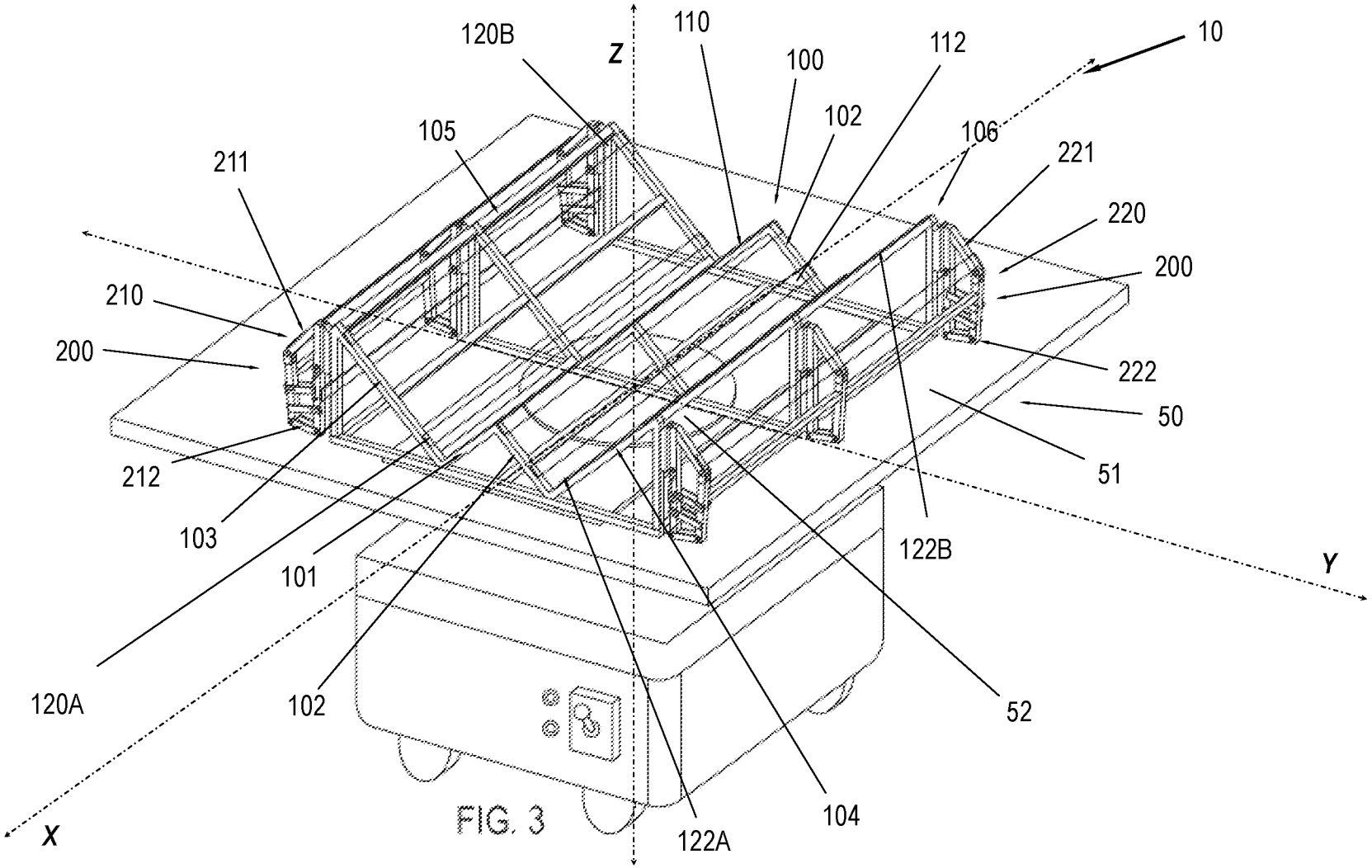
FIG. 3 illustrates a top perspective view of an adjustable cabinet assembly apparatus having a cabinet assembly adjustment device of the adjustable cabinet assembly apparatus disposed in a first assembly configuration according to one example aspect of the present disclosure.
Figure 4:
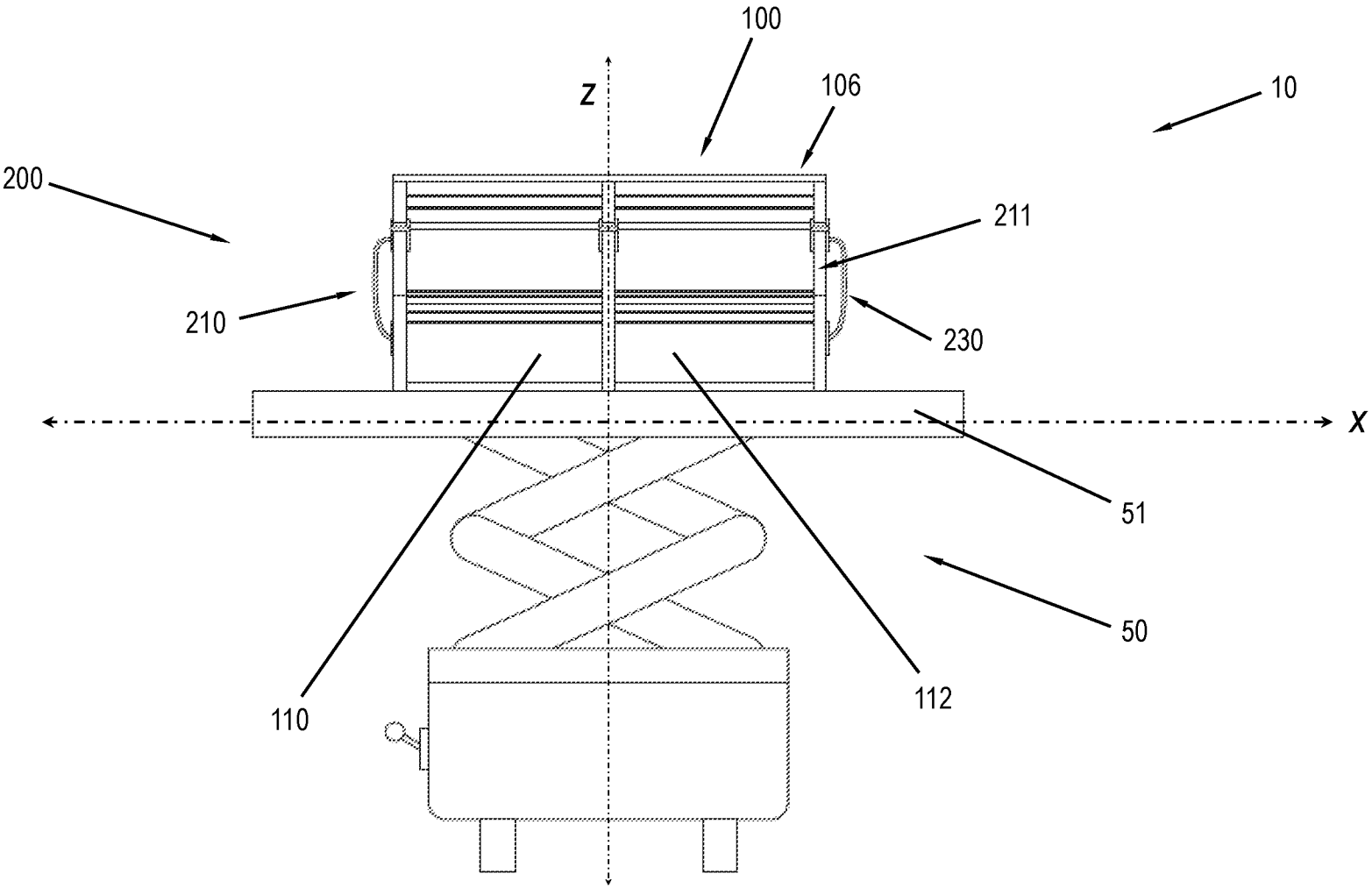
FIG. 4 illustrates a side view of an adjustable cabinet assembly apparatus according to one example aspect of the present disclosure.

Implementations of the present disclosure provide for an adjustable cabinet assembly apparatus as shown in FIGS. 1-6. According to some aspects of the present disclosure, an adjustable cabinet assembly apparatus 10, as shown in FIGS. 1-3, may provide for an adjustable assembly of cabinetry, such as, for example, a kitchen cabinet and/or a corner kitchen cabinet unit. In some aspects, the adjustable cabinet assembly apparatus 10 may provide for a faster and more accurate assembly of cabinetry, such as, for example a kitchen corner cabinet unit. According to some aspects, multiple sized cabinetry, such as, for example, easy reach cabinetry, corner base cabinetry, and/or wall base cabinetry may be operably engaged by the adjustable cabinet assembly apparatus 10 for accurate assembly.

For example, the adjustable cabinet assembly apparatus 10 may include a cabinet assembly frame 100 configured to maintain the correct positional relationship of portions of a cabinetry to be assembled, such as, for example a kitchen corner base cabinetry. The adjustable cabinet assembly apparatus 10 may further include a rotatable base member 52 of a base member device 50 configured to provide for adjustable assembly of a cabinetry unit like a kitchen corner base cabinetry unit. In particular, the rotatable base member 52 may be securely engaged with a portion of the cabinet assembly frame 100 such that rotation of the rotatable base member 52 about the vertical axis Z of the adjustable cabinet assembly apparatus 10 would produce rotation of the cabinet assembly frame 100 about the vertical axis Z. Further, rotation of the cabinet assembly frame 100 about the vertical axis Z of the adjustable cabinet assembly apparatus 10 would produce a rotation of the rotatable base member 52 about the vertical axis Z.

Further, the rotatable base member 52 may be operably engaged with a base plate 51 of a base member device 50 such that vertical movement of the base plate 51 along the vertical axis Z of the adjustable cabinet assembly apparatus 10 would produce a corresponding vertical movement of the rotatable base member 52.

Referring to FIGS. 1 and 2, the adjustable cabinet assembly apparatus 10 may include a cabinet assembly frame 100 that includes a first cabinet face support surface 110 and a second cabinet face support surface 112. According to some aspects, the adjustable cabinet assembly apparatus may also include a first cabinet side support surface 120 and a second cabinet side support surface 122. As shown in FIGS. 1 and 2, an adjustable cabinet assembly apparatus may include a plurality of cabinet side support surfaces 120A, 120B, configured to engage a first cabinet side of a kitchen corner cabinetry, and a plurality of cabinet side support surfaces 122A, 122B, configured to engage a second corresponding cabinet side of the kitchen corner cabinetry In yet other example aspects, the adjustable cabinet assembly apparatus 10 may include any number of cabinet side support surfaces configured to operably engage a corresponding cabinet side, and cabinet face support surfaces configured to operably engage a corresponding cabinet face. As shown in FIG. 2, the cabinet assembly frame 100 may include a first cabinet assembly frame portion 101 and a second cabinet assembly frame portion 102 configured to position the cabinet face support surfaces 110, 112 in a first assembly configuration. The first and second cabinet assembly frame portions 101, 102 may define a downward angle $\alpha$ therebetween that is at least 90 degrees or greater. As shown in FIG. 2, the first and second cabinet assembly frame portions 101, 102 define a downward angle α therebetween of 90 degrees.

According to some aspects, the cabinet assembly frame 100 may include a third cabinet assembly frame portion 103 configured to operably engage a first cabinet side support surface 120. The cabinet assembly frame 100 may include a fourth cabinet assembly frame portion 104 configured to operably engage a second cabinet side support surface 122. In some aspects, the first, second, third, and fourth cabinet assembly frame portions 101, 102, 103, 104 may define a peak-and-valley shaped cabinet assembly frame 100. For example, as shown in FIG. 2, the cabinet assembly frame 100 may include a first, second, third, and fourth cabinet assembly frame portions 101, 102, 103, 104 that define a W-shaped cabinet assembly frame when viewed from the front.

According to some aspects, a first peak may be disposed proximate a first, proximal end 105 of the cabinet assembly frame 100, a second peak may be disposed proximate an opposing second, distal end 106 of the cabinet assembly frame 100, and a third peak may be disposed proximate the midpoint between the proximate and distal ends 105, 106 of the cabinet assembly frame 100. In some aspects, the first and second ends 105, 106 of the cabinet assembly frame 100 may be longitudinally opposed from one another along a horizontal axis Y of the adjustable cabinet assembly apparatus 10. Additionally, the third peak proximate the midpoint between the proximate and distal ends 105, 106 of the cabinet assembly frame 100, may be disposed at a lower elevation than the first and second peaks disposed proximate the first and second ends 105, 106 of the cabinet assembly frame 100 along the vertical axis Z, as shown, for example, in FIG. 2.

In at least some aspects, the cabinet assembly frame 100 may include a first cabinet face support surface 110, a second cabinet face support surface 112, a first cabinet side support surface 120, and a second cabinet side support surface 122 that define a positional relationship of a cabinetry unit, such as, for example a kitchen corner cabinetry, in a first assembly configuration. According to some aspects, the first assembly configuration of the cabinet assembly frame 100 may provide for the accurate and quick assembly of a kitchen corner cabinetry having a first, larger size than a second, differing, smaller kitchen corner cabinetry. As shown in FIG. 2, the first assembly configuration of the adjustable cabinet assembly apparatus 10 may provide for a first, larger size kitchen corner cabinetry.

The adjustable cabinet assembly apparatus 10 may further include a cabinet assembly adjustment device 200 configured to adjust the cabinet assembly apparatus 10 between the first assembly configuration and a second assembly configuration. In some aspects, the second assembly configuration may accommodate a differently sized kitchen corner cabinetry, such a smaller kitchen corner cabinetry.

Figure 5:
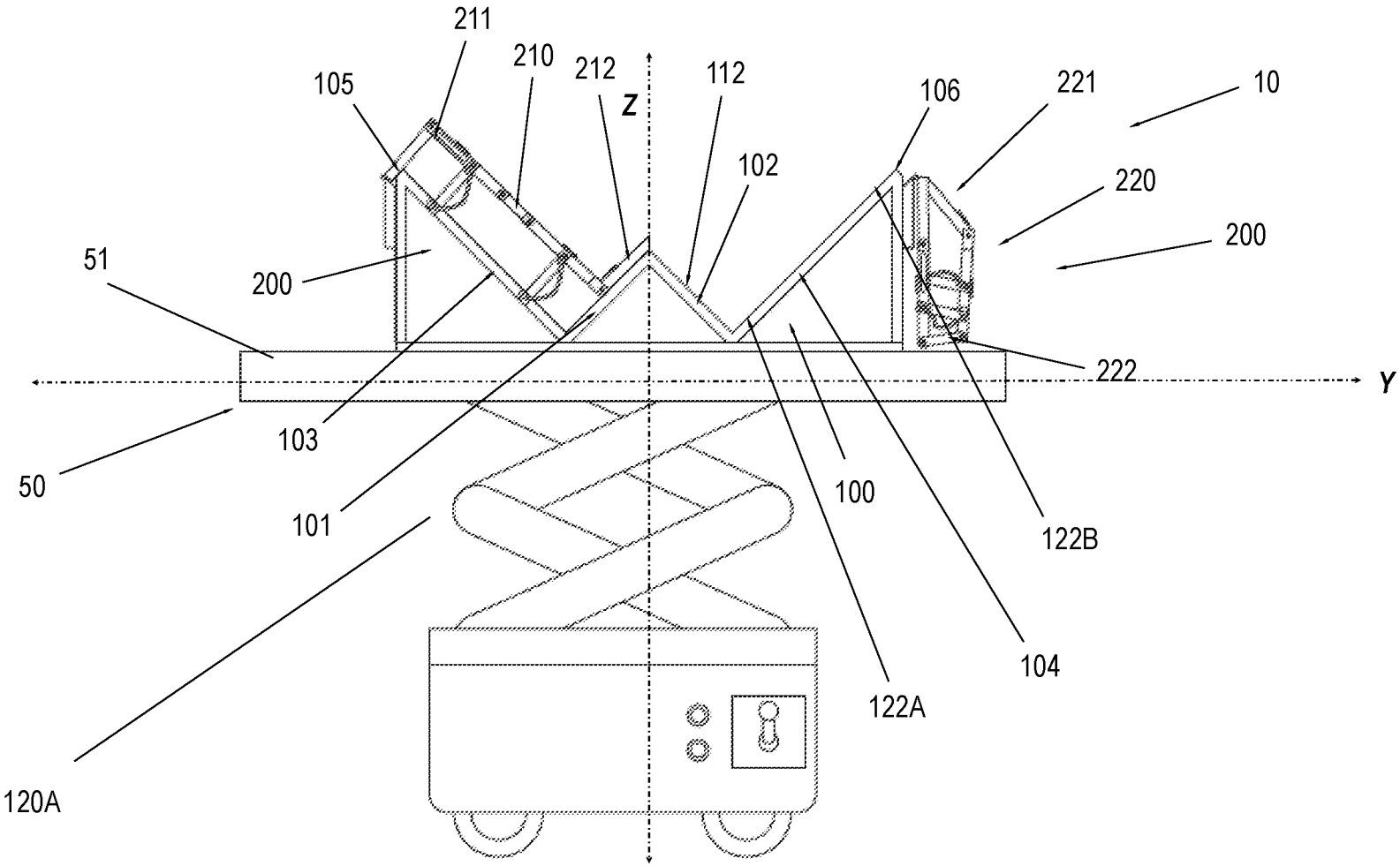
FIG. 5 illustrates a front view of an adjustable cabinet assembly apparatus with at least a portion of a cabinet assembly adjustment device engaging a cabinet assembly frame to adjust the adjustable cabinet assembly apparatus between a first assembly configuration and a second assembly configuration according to one example aspect of the present disclosure.
Figure 6:
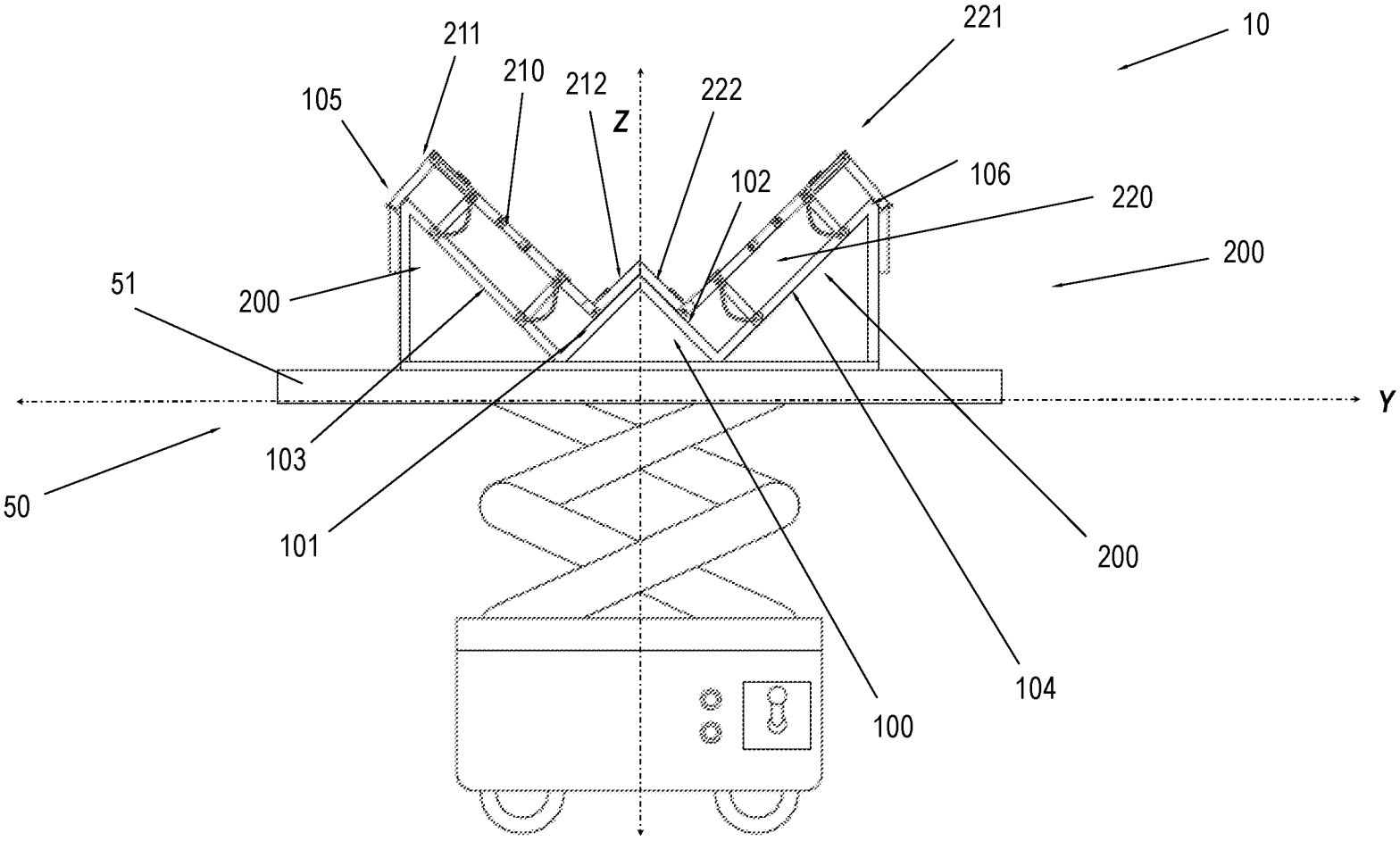
FIG. 6 illustrates a front view of an adjustable cabinet assembly apparatus configured in a second assembly configuration according to one example aspect of the present disclosure.

Referring to FIGS. 2, 5 and 6, an adjustable cabinet assembly apparatus may include a first arm 210 and a second arm 220. In some aspects, the first arm 210 may include a first arm flap 211 and a first arm tip 212. According to one aspect, the second arm 220 may include a second arm flap 221 and a second arm tip 222. As shown in FIG. 3, the first arm 210 may be disposed proximate the first proximal end 105 of the cabinet assembly frame 100, and the second arm 220 may be disposed proximate the opposing second distal end 106 of the cabinet assembly frame 100. In particular, the first arm flap 211 of the first arm 210 may be operably engaged with the cabinet assembly frame 100 proximate the first end 105 of the cabinet assembly frame 100. In some aspects, the first arm flap 211 may be hingedly engaged with cabinet assembly frame 100 such that the first arm 210 may rotate about the horizontal axis X with respect to the cabinet assembly frame 100. Likewise, the second arm 220 may be operably engaged with the cabinet assembly frame 100 proximate the opposing second end 106 of the cabinet assembly frame 100 so as to rotate about the horizontal axis X with respect to the cabinet assembly frame 100.

Referring to FIG. 5, the first arm tip 212 may be disposed proximate the distal end 215 of the first arm flap 211, and according to some aspects, may be operably engaged with the first arm flap 211 such that the first arm tip 212 may rotate with respect to the first arm flap 211. In some aspects, the second arm tip 222 may be disposed proximate the distal end 225 of the second arm flap 221, and according to one aspect, may be operably engaged with the second arm flap 221 such that the second arm tip 222 may rotate with respect to the second arm flap 221. Additionally, the first arm flap 211 may be hingedly engaged with the first arm tip 212, and the second arm flap 221 may be hingedly engaged with the second arm tip 222.

In some aspects, the first arm 210 and/or the second arm 220 may include a securing element 230. As shown in FIG. 5, the first arm 210 is disposed in the second assembly configuration, while the second arm 220 is disposed in the first assembly configuration. According to one aspect, the first arm 210 may include a securing element 230 configured to temporarily secure the first arm 210 in the second assembly configuration. In particular, the first arm 210 may define an aperture 231 configured to reciprocally engage a pin 232 such that the first arm 210 remains securely positioned with respect to the cabinet assembly frame 100. In some aspects, the cabinet assembly frame 100 may define an aperture configured to reciprocally engage a pin 232 such that the first arm 210 remains securely positioned with respect to the cabinet assembly frame 100.

Likewise, the second arm 220 may include a securing element 230 configured to temporarily secure the second arm 220 in the second assembly configuration, as shown in FIG. 6. The second arm 220 may define at least one aperture 231 configured to reciprocally engage a pin 232 of the securing element 230 such that the second arm 220 remains securely positioned with respect to the cabinet assembly frame 100. In some aspects, the cabinet assembly frame 100 may define an aperture configured to reciprocally engage a pin 232 such that the second arm 220 remains securely positioned with respect to the cabinet assembly frame 100.

As shown in FIG. 6, the adjustable cabinet assembly apparatus 10 configured in a second assembly configuration may now engage a smaller sized cabinetry, such as easy reach cabinetry, corner base cabinetry, and/or wall base cabinetry. Although FIG. 6 illustrates the second assembly configuration of the adjustable cabinet assembly apparatus 10 being configured to engage a smaller sized cabinet face and a similar sized cabinet side, one of ordinary skill in the art may appreciate that the cabinet assembly adjustment device may be configured to adjust the cabinet assembly apparatus 10 to engage any suitable sized cabinetry.

The foregoing description comprises illustrative embodiments. Having thus described example embodiments, it should be noted by those skilled in the art that the within disclosures are example only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

The invention claimed is:

1. An adjustable cabinet assembly apparatus, the apparatus comprising:

a rotatable base member;

a cabinet assembly frame comprising at least a first cabinet face support surface and a second cabinet face support surface and at least a first cabinet side support surface and a second cabinet side support surface, the cabinet assembly frame operably engaged with the rotatable base member;

a cabinet assembly adjustment device configured to operably engage with the cabinet assembly frame, the cabinet assembly adjustment device configured to adjust the cabinet assembly apparatus between a first assembly configuration and a second assembly configuration, wherein the cabinet assembly adjustment device further includes:

a first arm flap disposed proximate a first end of the cabinet assembly frame;

a second arm flap disposed proximate a second end of the cabinet assembly frame, the second end being longitudinally opposed to the first end of the cabinet assembly frame;

a first arm tip disposed proximate a first end of the first arm flap; and a second arm tip disposed proximate a first end of the second arm flap, wherein the first arm flap, the second arm flap, the first arm tip, and the second arm tip are operably engaged with the cabinet assembly frame to adjust the cabinet assembly apparatus between the first assembly configuration and the second assembly configuration, wherein the first arm flap defines a third cabinet side support surface, the second arm flap defines a fourth cabinet side support surface, the first arm tip defines a third cabinet face support surface, and the second arm tip defines a fourth cabinet face support surface.

2. The apparatus of claim 1, wherein the cabinet assembly adjustment device comprises:

at least one arm flap disposed proximate the cabinet assembly frame; and at least one arm tip disposed proximate a distal end of the at least one arm flap, the at least one arm tip being configured to operably engage the distal end of the at least one arm flap, and wherein the at least one arm flap and the at least one arm tip are operably engaged with the cabinet assembly frame to adjust the cabinet assembly apparatus between the first assembly configuration and the second assembly configuration.

3. The apparatus of claim 2, wherein the at least one arm flap disposed proximate the cabinet assembly frame defines at least one securing aperture.

4. The apparatus of claim 3, wherein the cabinet assembly apparatus further comprises at least one securing element, the at least one securing element configured to operably engage the at least one securing aperture.

5. The apparatus of claim 1, wherein the first cabinet face support surface and the second cabinet face support surface define a downward angle therebetween that is at least 90 degrees, and wherein the third cabinet face support surface and the fourth cabinet face support surface define a downward angle therebetween when disposed in the second cabinet assembly configuration that is at least 90 degrees.

6. The apparatus of claim 5, wherein a longitudinal length of the first cabinet face support surface and a longitudinal length of the second cabinet face support surface are greater than a longitudinal length of the third cabinet face support surface and a longitudinal length of the fourth cabinet face support surface.

7. The apparatus of claim 5, wherein a longitudinal length of the first cabinet side support surface and a longitudinal length of the second cabinet side support surface are greater than a longitudinal length of the third cabinet side support surface and a longitudinal length of the fourth cabinet side support surface.

* * * * *